US008136885B2

(12) United States Patent
Perlstein

(10) Patent No.: US 8,136,885 B2
(45) Date of Patent: Mar. 20, 2012

(54) METHOD AND APPARATUS FOR PROVIDING REST FOR THE FEET OF CHILDREN WITH SPECIAL NEEDS

(76) Inventor: Elizabeth Perlstein, Huntington, NY (US)

( * ) Notice: Subject to any disclaimer, the term of this patent is extended or adjusted under 35 U.S.C. 154(b) by 64 days.

(21) Appl. No.: 12/396,783

(22) Filed: Mar. 3, 2009

(65) Prior Publication Data

US 2010/0060068 A1 Mar. 11, 2010

Related U.S. Application Data

(60) Provisional application No. 61/033,591, filed on Mar. 4, 2008.

(51) Int. Cl.
*A47B 97/00* (2006.01)
*A47C 16/00* (2006.01)

(52) U.S. Cl. ..... 297/463.2; 297/423.4; 297/423.41

(58) Field of Classification Search ..... 297/463.2, 297/423.1, 423.39, 423.4, 423.41, 423.45, 297/463.1; 248/501, 500, 188.1, 188.8; 482/52; 108/50.14, 50.11, 151, 155
See application file for complete search history.

(56) References Cited

U.S. PATENT DOCUMENTS

| | | | | |
|---|---|---|---|---|
| 121,344 | A | 11/1871 | Elder | |
| D139,325 | S | 10/1944 | Gass | |
| D139,702 | S | 12/1944 | Castle | |
| D157,436 | S * | 2/1950 | Rogers | D25/65 |
| 2,611,416 | A | 9/1952 | Moore, II | |
| D172,201 | S | 5/1954 | Staveley | |
| 2,869,620 | A | 1/1959 | Gleitsman | |
| D197,558 | S | 2/1964 | Sokolis | |
| 3,271,075 | A | 9/1966 | Good | |
| D213,496 | S | 3/1969 | Wormser | |
| D214,494 | S | 6/1969 | Ellsworth et al. | |
| 3,704,847 | A | 12/1972 | Schmitt | |
| 4,191,113 | A | 3/1980 | Hogberg | |
| D276,861 | S | 12/1984 | Keddie | |
| D279,238 | S | 6/1985 | Ferdinand et al. | |
| D287,434 | S | 12/1986 | Wolfe et al. | |
| D295,001 | S | 4/1988 | Ferdinand et al. | |
| D297,790 | S | 9/1988 | Melvin | |
| 4,813,742 | A | 3/1989 | Cardinael | |
| D312,736 | S | 12/1990 | Grosfillex | |
| D324,085 | S | 2/1992 | Morton | |
| D331,808 | S | 12/1992 | Paul et al. | |
| D335,966 | S | 6/1993 | Schwartzkopf et al. | |
| 5,312,155 | A | 5/1994 | Akima et al. | |
| 5,352,168 | A * | 10/1994 | Wilkinson | 482/55 |
| D390,711 | S | 2/1998 | Pearl | |
| 5,865,710 | A * | 2/1999 | Wilson-Hyde | 482/52 |
| 6,036,158 | A * | 3/2000 | Raasch | 248/441.1 |
| D455,277 | S | 4/2002 | Hutton | |
| D479,407 | S | 9/2003 | Waybrant et al. | |
| D482,879 | S | 12/2003 | Arendt et al. | |
| 6,682,147 | B1 * | 1/2004 | Leoutsakos | 297/423.41 |
| 6,846,043 | B1 | 1/2005 | Leoutsakos | |
| D508,336 | S | 8/2005 | Suzuki et al. | |
| 7,017,708 | B1 * | 3/2006 | Lynn | 182/35 |
| 7,066,547 | B1 | 6/2006 | Russell et al. | |
| 7,114,452 | B1 * | 10/2006 | Owen | 108/44 |
| D539,552 | S | 4/2007 | Dalmau | |
| D542,546 | S | 5/2007 | Rubio | |
| 2007/0262633 | A1 * | 11/2007 | Stoffer | 297/423.4 |

* cited by examiner

*Primary Examiner* — Milton Nelson, Jr.

(57) ABSTRACT

The present invention provides a new and unique method and apparatus for providing rest for the feet of special needs. More particularly, present invention provides a new and unique foot rest that is easily anchored to any standard elementary school-sized chair and that allows a student to sit with proper posture and alignment, as well as get sensory input from having his/her feet on a solid surface.

8 Claims, 3 Drawing Sheets

METHOD AND APPARATUS FOR PROVIDING REST FOR THE FEET OF CHILDREN WITH SPECIAL NEEDS

CROSS-REFERENCE TO RELATED APPLICATIONS

This application claims benefit to provisional patent application Ser. No. 61/033,591, filed 4 Mar. 2008, which is hereby incorporated by reference in its entirety.

BACKGROUND OF THE INVENTION

1. Field of the Invention

The present invention relates to a method and apparatus for providing rest for the feet of children with special needs; and more particularly relates to a foot rest that is easily anchored to any standard elementary school-sized chair and that allows a student to sit with proper posture and alignment, as well as get sensory input from having his/her feet on a solid surface.

2. Brief Description of Related Art

In the prior art, it is known to use a Rifton chair, which is a wooden specialized chair for children who need significant support to stay seated.

Moreover, it is also known that some student with special needs may not require a Rifton chair; however, when such students are sitting in a regular kindergarten-sized chair, they may still not have their feet touching the ground. FIG. 1 shows one such student sitting on a standard elementary school chair that is known in the art with his feet dangling above the floor. It is the experience of the inventor, that this child would typically be distracted throughout class, and would often fall out of their chair, trying to have their feet supported. When a traditional foot rest or phone book was placed under his feet, the student would typically kick it away in seconds.

The present invention provides a solution to this problem in the art.

SUMMARY OF THE INVENTION

The present invention provides a new and unique method and apparatus for providing rest for the feet of a child having special needs.

The method may include anchoring a chair in relation to a specialized foot rest having a platform with an elongated slot, including a wide oval slot, and having the platform being arranged on a support member with an open bottom, by positioning one or more front legs of the chair through the wide oval slot so as to allow them to rest on the floor so that the chair cannot be kicked or pushed away from the specialized foot rest; and positioning a child having special needs on a seat of the chair so that the feet of the child can rest comfortably on the platform of the specialized foot rest so as to substantially increase the likelihood that the child will sit with proper posture and alignment and receive sensory input from having the feet of the child resting on the solid surface of the platform, so as to substantially decrease the likelihood that the child will be distracted by one or more dangling feet that would not otherwise touch the ground without using the specialized foot rest, and/or so as to substantially decrease the likelihood that the child will fall out of or off the chair.

The wide oval slot may be configured with the following dimensions:

width: about 1.5 inches and length: about 15-16 inches.

The platform may be configured with predetermined dimensions, including a width of about 12" and a length of about 18", the platform is about 4" above ground level when the one or more front legs of the chair are resting on the ground, and the wide oval slot is configured along the length about 3" from the back of the platform.

Alternatively, the platform may be configured with predetermined dimensions, including a width of about 12" and a length of about 20", the platform is about 6" above ground level when the chair is resting on the ground, and the wide oval slot is configured along the length about 3" from the back of the platform.

The platform may also be configured with one or more abrasive strips arranged thereon to provide frictional engagement with the feet of the child, and an overhang for easily picking up and moving the specialized foot rest.

The apparatus may take the form of the specialized foot rest featuring the support member having the open bottom; and the platform being arranged on the support member and having the wide oval slot configured to receive the one or more front legs so that the chair cannot be kicked or pushed away from foot rest and so that the child having special needs may be positioned on the seat of the chair so that the feet of the child can rest comfortably on the platform of the specialized foot rest so as to substantially increase the likelihood that the child will sit with proper posture and alignment and receive sensory input from having the feet of the child resting on a solid surface of the platform, so as to substantially decrease the likelihood that the child will be distracted by one or more dangling feet that would otherwise not touch the ground without using the specialized foot rest, and/or so as to substantially decrease the likelihood that the child will fall out of the chair.

Embodiments of the invention may also include using two openings in the platform instead of the wide oval slot, where each of one or more front legs of the chair are positioned through a respective one of the two openings so that the chair cannot be kicked or pushed away from the specialized foot rest.

Embodiments of the invention may also include adapting, configuring or dimensioning the length of one or more adjustable legs affixed on each corner on the bottom of the specialized foot rest depending on the length of the legs of the child.

In effect, the present invention provides a new and unique foot rest that is easily anchored to any standard elementary school-sized chair and that allows a student to sit with proper posture and alignment, as well as get sensory input from having his/her feet on a solid surface. The new and unique foot rest is also referred to as a "Jett Step," which was named after a child having special needs that was my inspiration for this invention.

The apparatus according to the present invention is a specialized foot rest that is easily anchored to any standard elementary school-sized chair (different sizes available) that allows a student to sit with proper posture and alignment, as well as get sensory input from having his/her feet on a solid surface. It was originally designed to accommodate a student with special needs who did not require a Rifton chair (a wooden specialized chair for children who need significant support to stay seated), but whose feet did not touch the ground in a regular kindergarten-sized chair. His feet were dangling and he would be distracted throughout class, and would often fall out of his chair, trying to have his feet supported. When a traditional foot rest or phone book was placed under his feet, he would kick it away in seconds. Upon further investigation in other Special Education classrooms, it was evident that there were many students in the same predicament.

The apparatus provides a solution to this problem in the art, by allowing a student to sit with proper posture and alignment, as well as to get sensory input from having his/her feet on a solid surface.

DETAILED DESCRIPTION OF THE INVENTION

Figure 1:
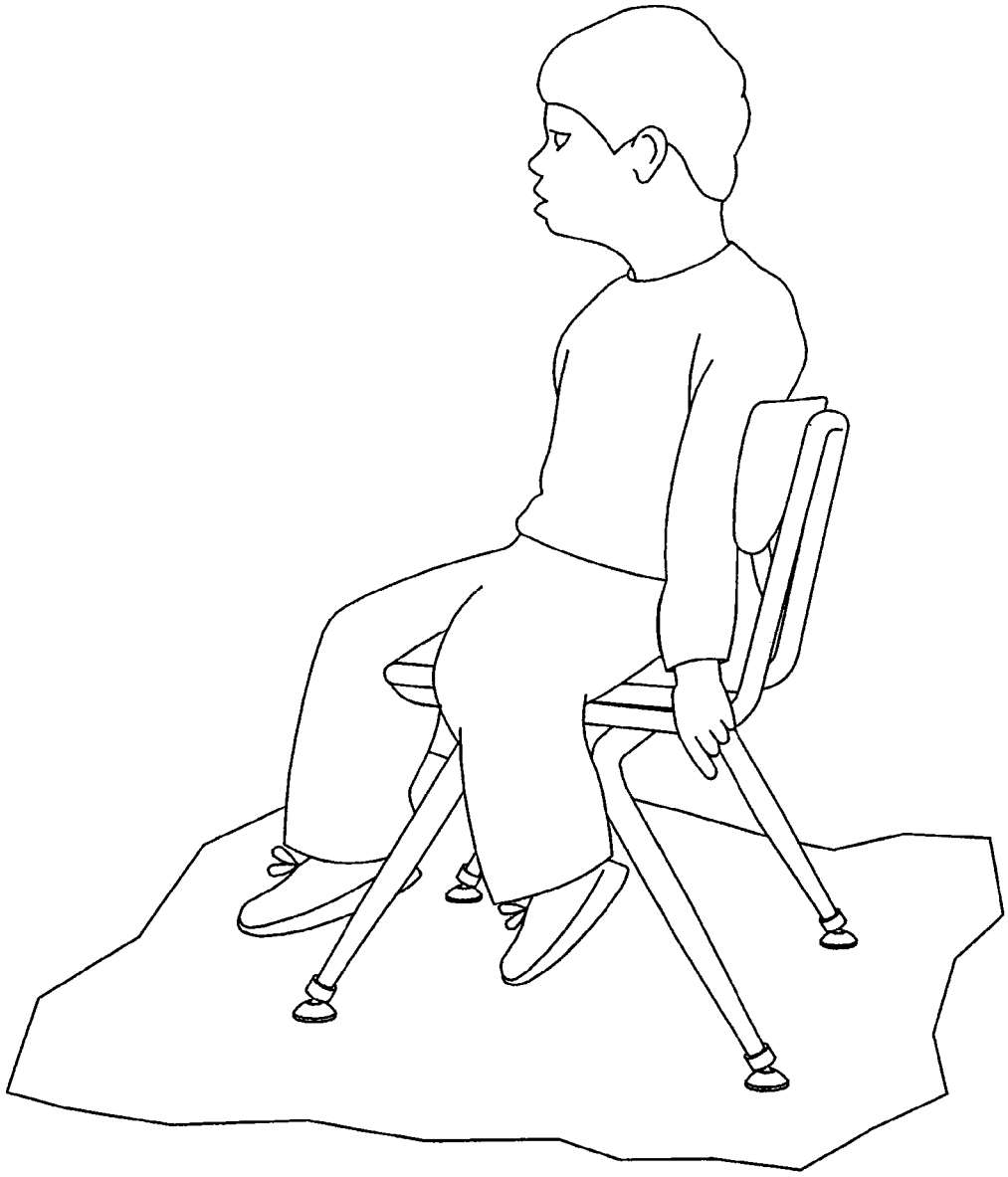
FIG. 1 PRIOR ART
FIG. 1 is an illustration of a child sitting on a standard elementary school chair that is known in the art.

This present invention provides a new and unique method and apparatus providing rest for the feet of children, including those with special needs.

FIG. 2 shows apparatus A and apparatus B according to the present invention, which are specialized foot rests that are easily anchored to any standard elementary school-sized chair (different sizes available) and that allows a student or child, e.g. with special needs, to sit with proper posture and alignment, as well as get sensory input from having his/her feet on a solid surface. FIGS. 2*a* and 2*b* show the two apparatuses A and B, with the apparatus B in FIG. 2*a* being taller than the apparatus A in FIG. 2*b*. The height of the particular apparatus being used would depend on the length of the legs of the child having special needs using the apparatus. It is important to note that the scope of the invention is not intended to be limited to the dimensions of the apparatus, including (but not limited to) the length, width or height thereof.

The apparatuses A and B in FIG. 2 take the form of bottomless boxes with a 1.5-inch wide slot 2 in the top $T_A$, $T_B$ to allow the front legs of the chair to enter or be positioned in, thereby anchoring itself to the chair so that it cannot be kicked or pushed away. As shown in FIGS. 2*a* and 2*b*, there are 2 different sizes for the apparatuses, but it can be easily custom made to fit any four-legged chair, not being limited to the classroom.

Embodiments are envisioned where the height of the apparatuses may be adapted, configured or dimensioned based on the length of the legs of a child, including, e.g., by having adjustable legs $L_1$, $L_2$ (see FIG. 2*b*) on all four corners that may be lengthened or shortened depending on the length of the legs of a particular child. Adjustable leg configurations are known in the art and the scope of the invention is not intended to be limited to any particular type or kind thereof either now known or later developed in the future. By way of example, the adjustable leg configurations may take the form of, or include, screw-like devices that have a padded base with an extended threaded bolt connected thereto that may be rotated into and out off a corresponding threaded socket or bolt-like configuration adapted or affixed in the bottom of each corner. These types or kinds of screw-like devices are typically used on the bottom of furniture legs so as to adjust the length of the legs of the furniture, e.g. for a table or stand, in relation to, e.g., uneven floors, so as to stabilize it. Alternatively, by way of example, the adjustable leg configurations may also take the form of, or include, as well as adjustable telescopic leg configurations that are known and used, e.g., in the legs of camera tripod configurations that are extended and frictionally locked with a hinged locking device, as well as telescopic extension devices that are extended and rotated to lock the same into position, like that used in extendable poles for devices for painting or for reaching lights on high ceilings.

Figure 2A:
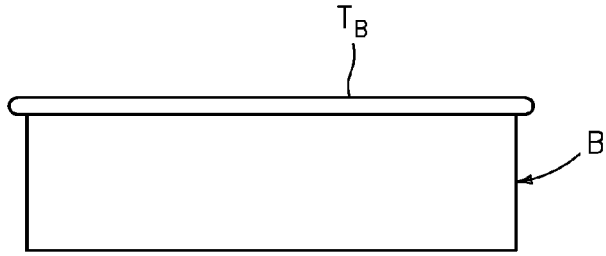
FIG. 2 includes illustrations of the apparatus according to the present invention, including FIGS. 2*a* and 2*b* showing side views of different embodiments of the apparatus A and B.
FIG. 2*c* which is a top down view of the apparatus A in FIG. 2*b*.
FIG. 2*d* which is a top perspective view of the apparatus B shown in FIG. 2*a*.
Figure 2B:
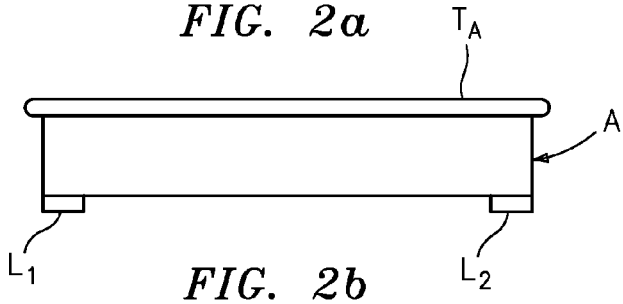
Figure 2C:
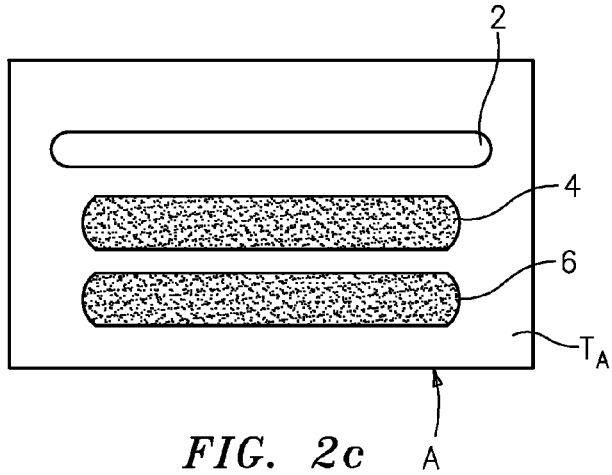

In FIGS. 2*b* and 2*c*, apparatus A has dimensions that include a top $T_A$ of about 12"×18" and a height of about 4" measured from the ground. The top $T_A$ has a wide oval slot 2 that is about a 1.5" wide (See FIG. 2*c*) and is about 1" from the sides to conserve space beneath the chair, as well as stay a stable and solid unit. This apparatus A has double bull-nosed edges around the top as well as in the slot to prevent wear and tear of the slot, as well for aesthetics. Having the rounded edges on the sides of the top is for aesthetics, as well as preventing injury that is likely to occur with about 90° edges. The slot 2 is about 3.0" from the back to give stability, and also allow enough room for the student's feet. There are two strips of adhesive traction tape 4, 6 on the top of the box so the student's feet do not slide. The foot rest top overhangs the base by about 0.5" so that it can be picked up easily, and because the top has bull-nosed edges and the base is about 90° edges, it helps to prevent injury when transferring into the chair. Along the base edges of the foot rest, there is felt to aid in sliding the box along the floor when needed.

Figure 2D:
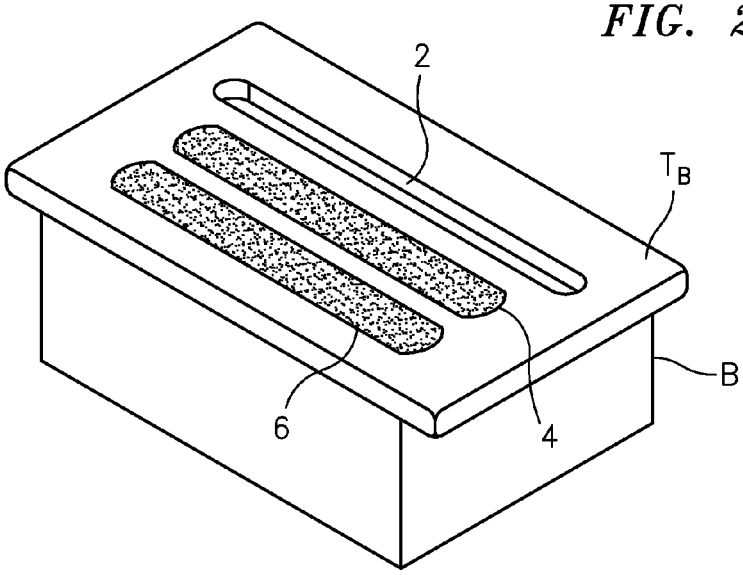
Figure 3:
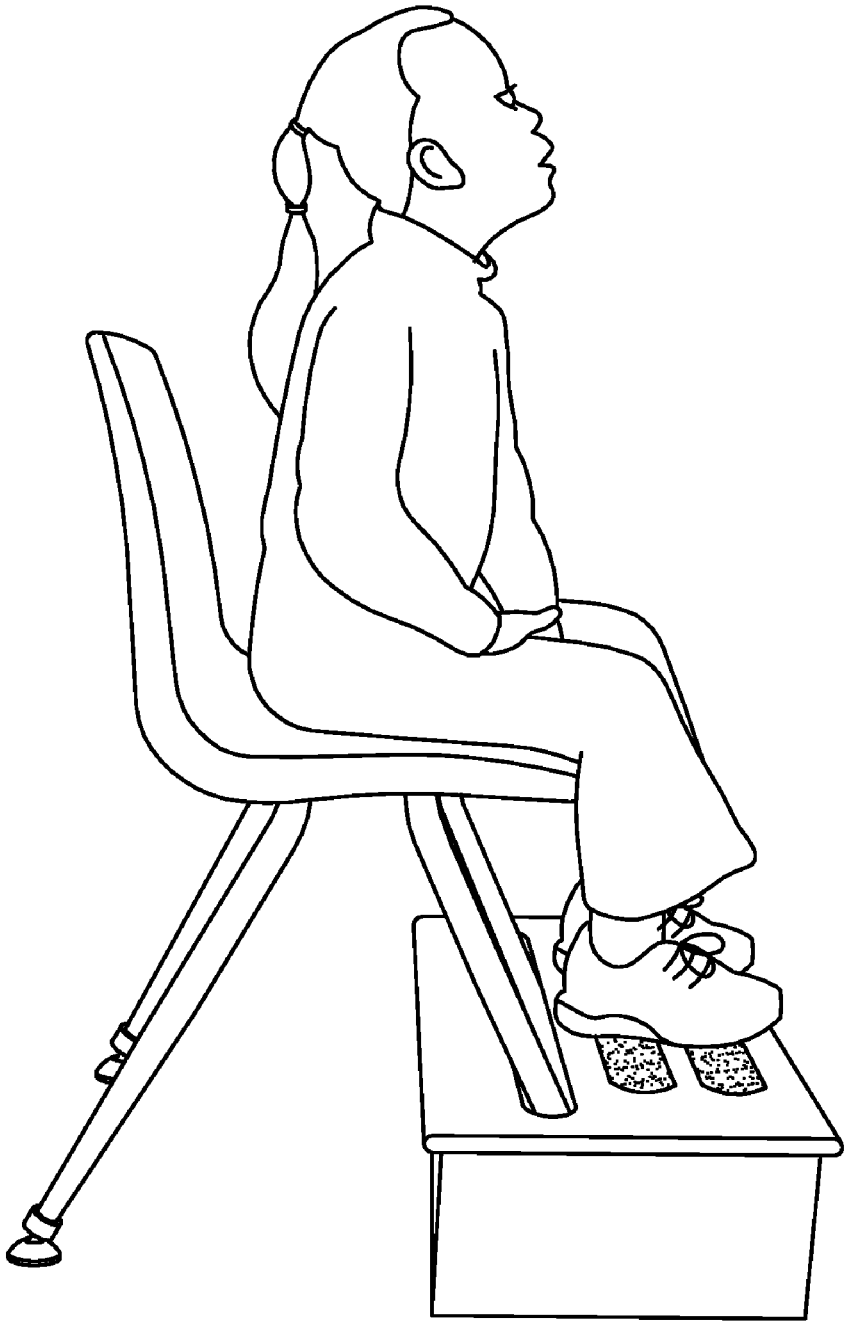
FIG. 3 is an illustration of the child sitting on the standard elementary school chair that is known in the art and using the apparatus according to some embodiments of the present invention.

The slightly larger apparatus B shown in FIGS. 2*a*, 2*d* has dimensions that include a top $T_B$ of about 12"×20" and a height of about 6" high. The lid is the same design as size A, and each size may have either a 4" or 6" height. This apparatus is made out of about 0.75" clear pine and the lid is a laminated pine for aesthetics. Two coats of polyurethane are applied. Pine was chosen because of its weight and durability, although the scope of the invention is not intended to be limited to the type or kind of materials from which the step is made.

The scope of the invention is not intended to be limited to the size or shape of the slot 2. Embodiments are envisioned in which the apparatus has a large length, a larger width, or some combination thereof in order to be adapted to allow or receive the front legs of to any standard elementary school-sized chair either now known or later developed in the future to enter, thereby anchoring itself to the chair so that it cannot be kicked or pushed away.

The scope of the invention is not intended to be limited to the type or kind of materials that the apparatus in made from, and is intended to include material now known and later developed in the future.

Further, embodiments are also envisioned in which the slot takes the form of two separate openings on the left and right sides of the top instead of one wide oval hole.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What is claimed is:

1. A method for providing rest for the feet of a special needs child, comprising:

anchoring a chair in relation to a specialized foot rest having a platform with an elongated slot, including a wide oval slot, and having the platform being arranged on a support member with an open bottom, by positioning two front legs of the chair through the wide oval slot so as to allow them to rest on a floor so that the chair cannot be kicked or pushed away from the specialized foot rest; and positioning a child having special needs on a seat of the chair so that the feet of the child can rest comfortably on the platform of the specialized foot rest so as to substantially increase the likelihood that the child will sit with proper posture and alignment and receive sensory input from having the feet of the child resting on a solid surface of the platform, so as to substantially decrease the likelihood that the child will be distracted by one or more dangling feet that would not otherwise touch the ground without using the specialized foot rest, and/or so as to substantially decrease the likelihood that the child will fall out of or off the chair.

2. A method according to claim 1, wherein the wide oval slot is configured with the following dimensions:

width: about 1.5 inches and length: about 15-16 inches.

3. A method according to claim 1, wherein the platform is configured with predetermined dimensions, including a width of about 12" and a length of about 18", the platform is about 4" above ground level when the two front legs of the chair are resting on the ground, and the wide oval slot is configured along the length about 3" from the back of the platform.

4. A method according to claim 1, wherein the platform is configured with predetermined dimensions, including a width of about 12" and a length of about 20", the platform is about 6" above ground level when the two front legs of the chair are resting on the ground, and the wide oval slot is configured along the length about 3" from the back of the platform.

5. A method according to claim 1, wherein the platform is configured with one or more abrasive strips arranged thereon to provide frictional engagement with the feet of the child.

6. A method according to claim 1, wherein the chair is a standard elementary school-sized chair.

7. A method according to claim 1, wherein the platform is configured with an overhang for easily picking up and moving the specialized foot rest.

8. A method according to claim 1, wherein the method comprises adapting, configuring or dimensioning the length of one or more adjustable legs affixed on each corner on the bottom of the specialized foot rest depending on the length of the legs of the child.

* * * * *